US010473386B2

(12) United States Patent
Cakirca et al.

(10) Patent No.: US 10,473,386 B2
(45) Date of Patent: Nov. 12, 2019

(54) HOUSEHOLD COOLING APPLIANCE INCLUDING A DISPENSER UNIT FOR LIQUID AND/OR FREE FLOW REFRIGERATED GOODS, HAVING AN INSERT WITH A NICHE AND A SEPARATE COVER FOR INSERTION WALLS

(71) Applicant: BSH HAUSGERAETE GMBH, Munich (DE)

(72) Inventors: Volkan Cakirca, Istanbul (TR); Mehmet Ciyanoglu, Istanbul (TR); Lars Dinter, Munich (DE); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 110 days.

(21) Appl. No.: 15/606,971

(22) Filed: May 26, 2017

(65) Prior Publication Data

US 2018/0022598 A1 Jan. 25, 2018

(30) Foreign Application Priority Data

Jul. 19, 2016 (TR) ..... a 2016 09955

(51) Int. Cl.
*F25D 23/12* (2006.01)
*B67D 1/08* (2006.01)
(Continued)

(52) U.S. Cl.
CPC ..... *F25D 23/126* (2013.01); *B67D 1/0894* (2013.01); *B67D 1/1256* (2013.01);
(Continued)

(58) Field of Classification Search
CPC ..... B67D 1/0894; B67D 1/1256; B67D 2210/00036; F25D 23/028; F25D 23/126; F25D 2400/22; F25D 2400/361
(Continued)

(56) References Cited

U.S. PATENT DOCUMENTS 8,122,734 B2 2/2012 Buchstab et al.
8,966,927 B2 3/2015 Eckartsberg et al.
(Continued)

FOREIGN PATENT DOCUMENTS

WO 2007118787 A1 10/2007
WO 2009080635 A2 7/2009
WO 2009110674 A1 9/2009

*Primary Examiner* — Henry T Crenshaw
(74) *Attorney, Agent, or Firm* — Laurence A. Greenberg; Werner H. Stemer; Ralph E. Locher

(57) ABSTRACT

A household cooling appliance includes a dispenser unit for dispensing a liquid and/or free flow refrigerated goods. The dispenser unit includes an insert having side walls bounding a niche into which a receptacle can be inserted for receiving the liquid and/or the free flow refrigerated goods to be dispensed. At least the side walls are partly covered at the front side by a cover which is separate from the insert. At least one side wall includes an engagement recess for engagement with a tool and for lifting the cover from the insert with the tool and/or at least one side wall is partly covered on the front side by a plate-shaped cover that is separate from the insert and the cover is held on the side wall by at least one magnet.

16 Claims, 4 Drawing Sheets

(51) Int. Cl.
*F25D 23/02* (2006.01)
*B67D 1/12* (2006.01)

(52) U.S. Cl.
CPC .. *B67D 2210/00036* (2013.01); *F25D 23/028* (2013.01); *F25D 2400/22* (2013.01); *F25D 2400/361* (2013.01)

(58) Field of Classification Search
USPC ..... 62/389
See application file for complete search history.

(56) References Cited

U.S. PATENT DOCUMENTS

2008/0197736 A1* 8/2008 Himmelmann ..... H02K 1/2786 310/156.08
2009/0071184 A1* 3/2009 Buchstab ..... F25D 23/10 62/389
2009/0167125 A1* 7/2009 Zakrzewski ..... A47B 61/00 312/265.6
2010/0288105 A1* 11/2010 Rose ..... G09B 15/02 84/483.2
2011/0023525 A1* 2/2011 Eckartsberg ..... F25D 23/126 62/391
2011/0283734 A1* 11/2011 Koo ..... F25D 23/126 62/389
2012/0024003 A1* 2/2012 Kim ..... F25D 23/126 62/389
2012/0181304 A1* 7/2012 Kim ..... F25D 23/126 222/182
2013/0044440 A1* 2/2013 Hingrainer ..... H05K 7/1415 361/747
2014/0213883 A1* 7/2014 Banet ..... A61B 5/6802 600/395
2016/0316951 A1* 11/2016 Van Tassell, III ..... A47G 23/0241

* cited by examiner

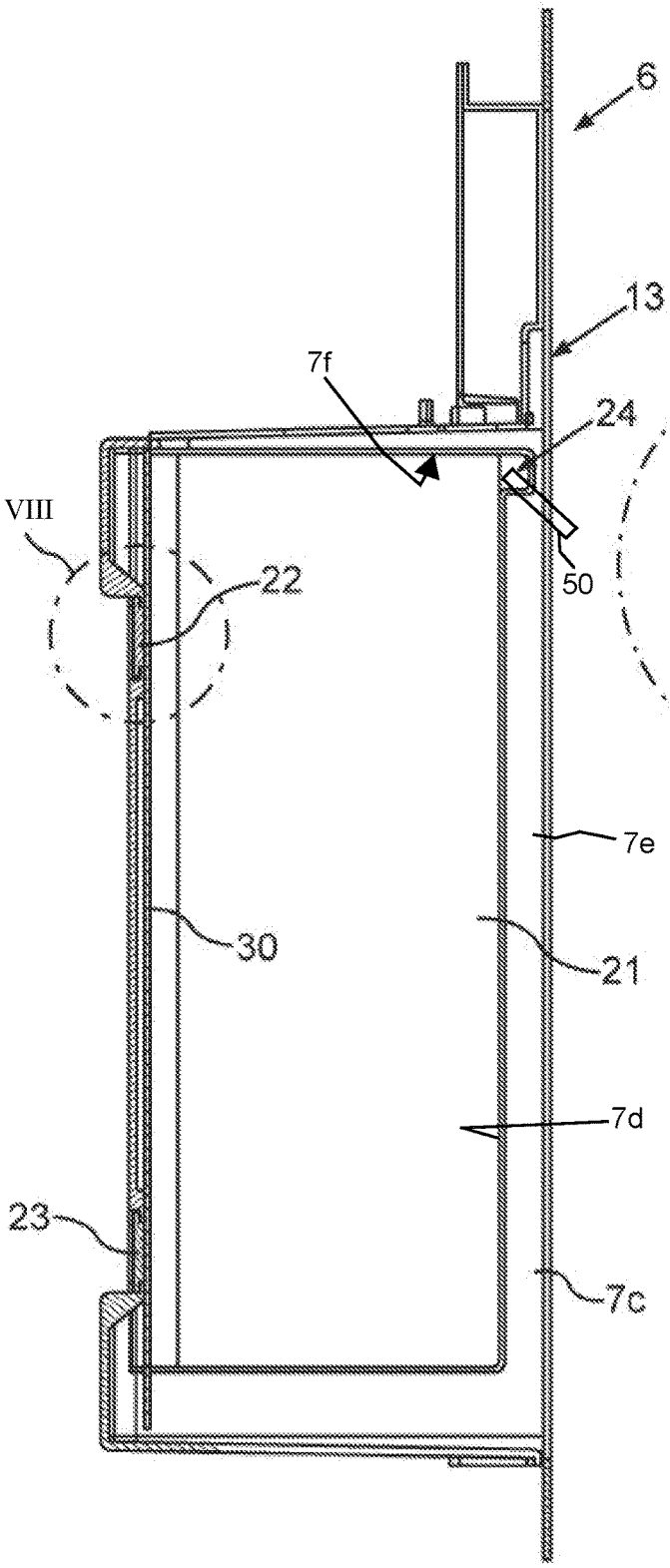
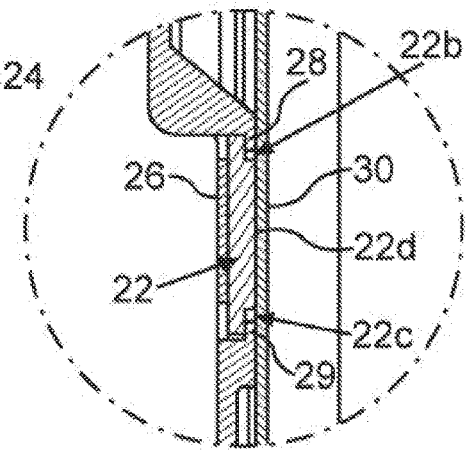
FIG. 8
Fig.7

HOUSEHOLD COOLING APPLIANCE INCLUDING A DISPENSER UNIT FOR LIQUID AND/OR FREE FLOW REFRIGERATED GOODS, HAVING AN INSERT WITH A NICHE AND A SEPARATE COVER FOR INSERTION WALLS

CROSS-REFERENCE TO RELATED APPLICATION

This application claims the priority, under 35 U.S.C. § 119, of Turkish Patent Application TR 2016/09955, filed Jul. 19, 2016; the prior application is herewith incorporated by reference in its entirety.

BACKGROUND OF THE INVENTION

Field of the Invention

The invention relates to a household cooling appliance including a dispenser unit which is configured for dispensing a liquid and/or free flow refrigerated goods. The dispenser unit includes an insert bounding a niche by walls. A receptacle can be inserted into the niche for receiving the liquid and/or the free flow refrigerated goods to be dispensed.

Household cooling appliances for storing and preserving food are known from the prior art. It is also known that in such appliances a door closing a receiving space for food is provided with an output unit or a dispenser unit for the liquid and/or free flow refrigerated goods, such as for instance ice cubes or crushed ice. Thus, dispensing of the liquid or free flow refrigerated goods is also facilitated with the door being closed. For instance, a corresponding dispenser unit is known from International Publication WO 2009/080635 A2, corresponding to U.S. Pat. No. 8,966,927.

Moreover, International Publication WO 2007/118787 A1, corresponding to U.S. Pat. No. 8,122,734, discloses a household cooling appliance including a dispenser device. Moreover, in that construction, an additional decorative plate, for instance a furniture front plate, is disposed on a front side of the door and is separate therefrom. The furniture front plate includes a hole or a recess, through which the dispenser unit or the niche of the output unit is also accessible. The dispenser unit is also attached to the decorative plate in that construction.

Moreover, a corresponding dispenser unit, which additionally also includes an electronics module, is known from International Publication WO 2009/110674 A1. That electronics module includes control elements and moreover also includes a display unit. Further, a separate drip tray can be inserted into the niche. The drip tray, however, is only placed up on a bottom side and magnetically held on the rear portion of a rear wall. The drip tray has a grid integrated as a cover of a drip well of the drip tray. In the known construction, the drip tray is easily shiftable. The niche walls easily become dirty and due to the depth of the niche those walls are then difficult to clean.

SUMMARY OF THE INVENTION

It is accordingly an object of the invention to provide a household cooling appliance including a dispenser unit for liquid and/or free flow refrigerated goods, having an insert with a niche and a separate cover for insertion walls, which overcomes the hereinafore-mentioned disadvantages of the heretofore-known devices of this general type and in which walls of the insert, which bound the niche of the dispenser unit for dispensing a liquid and/or free flow refrigerated goods, are protected. In particular, it is also an object of the invention to provide a household cooling device, in which the cleaning of walls directly bounding the niche is improved.

With the foregoing and other objects in view there is provided, in accordance with the invention, a household cooling appliance including a dispenser unit for dispensing a liquid and/or free flow refrigerated goods. The dispenser unit, which can also be referred to as an output unit, includes an, in particular box-shaped or tray-shaped, insert, which has vertical side walls bounding a niche. The niche moreover is in particular also bounded by a bottom wall and a ceiling wall, which end in the side walls of the insert. A receiving vessel for receiving the liquid and/or free flow refrigerated goods can be inserted into the niche. An important concept of the household cooling appliance according to the first independent aspect of the invention is to be seen in that the vertical side walls of the insert are partly covered on the front side and thus towards the niche by a cover that is separate from the insert. At least one side wall includes an engagement recess, which is constructed for engagement with a tool and then for lifting the cover from the side wall with the tool. In such a construction it is achieved that the walls of the insert towards the niche are once again covered and thus cannot be contaminated. The portions of the walls of the insert possibly not covered by the cover, on the other hand, are easy to clean, since they are easily accessible. Since the cover is a component that is separate from the insert, it can also be handled individually and independently of the insert and for instance can be removed in particular from the insert, in order to then, for example, clean the cover separately. In this way then those walls of the cover, which thus directly bound the niche and possibly can be covered in dirt, are easy to clean comprehensively. Moreover, through the use of such a cover an individual construction of the niche is also facilitated and the very walls of the insert in this connection then need not be made from high-value material. Thus, the insert can also be manufactured from a simple material, for instance plastics, which in this connection then does not need to withstand the most varied influences. The cover is thus advantageous with regard to durability and with regard to dispensing the most varied depositing liquids as well as with regard to the possibility of manufacturing the insert from a low-cost material. In particular, it is then also an advantage that the insert can have a simpler construction with regard to an optical appearance since the walls at least in large portions are covered by the cover.

Since the cover in particular can also be removed in a non-destructively releasable way, the exchange of these covers can also be effected in an advantageous embodiment. Thus, individual surface structures of the niche can be created, since due to the color configuration and/or the structural surface construction, which are then also recognizable directly on the viewing side upon looking into the niche, manifold options are provided.

Through the use of the engagement recess an easy assembly and disassembly of the cover is achieved so that in this case, too, handling that is convenient to the user is facilitated. Moreover, this engagement recess also facilitates the avoidance of an undesired sliding off of the tool and thus an undesired scratching of a front side of the cover avoided.

In particular, it is envisaged that the engagement recess is partly formed in a front surface area of the side wall, which is not covered by the cover. Since this engagement recess is configured to be quasi orientated towards a niche opening of the niche, it is also easily accessible and a user does not need to first reach with a tool deep into the niche, in order to reach the engagement recess. Thereby, a more specific assembly and disassembly and thus also an enhanced handling of the tool for removing the cover from the insert is permitted. Since the engagement recess is at least partly exposed and not covered by the cover towards the niche, the handling and the insertion of a tool is also rendered easier.

In particular, it is envisaged that the engagement recess is partly formed in a surface area of the side wall, which is covered by the cover, so that the cover can be engaged from behind by engaging into the engagement recess. This is a very advantageous embodiment to the effect that the tool can thus reach behind the cover and thus the cover can then be lifted from the insert by a corresponding lever movement of the tool.

In particular, it is envisaged that the engagement recess is formed on a top end of the side wall. This means that in the height direction of the niche and thus also of the household cooling appliance the engagement recess is configured to be as far up as possible. Thereby a user does not need to bend down in an undesired way, in order to be able to reach the engagement recess with the tool. In particular, due to this local construction of the engagement recess, however, it is also achieved that due to the close position to the ceiling wall of the insert to a certain degree it does not centrally catch the user's eye when viewing the niche from the front and thus is not perceived by the user as reducing quality with regard to the construction of the dispenser unit. Thus, in the common position of this niche the engagement recess is not immediately recognizable when the niche is viewed from the front by an adult of corresponding height, but is covered by the ceiling wall of the insert quasi approximately in the viewing direction from above.

In particular, it is envisaged that the engagement recess in the assembled state of the cover is configured to protrude beyond a front edge of the cover to the niche opening towards the front into the side wall. Thereby finding the engagement recess with a tool is rendered very easy and moreover the precise insertion of the tool into the engagement recess is also given.

Preferably it is envisaged that the side wall of the insert includes a lowered receiving portion for the cover, in which the cover in the mounted state is disposed and at least partly immersed. The receiving portion is offset towards the back relative to a front edge of the side wall and thereby an elevated wall strip is formed between the front edge and the receiving portion. The cover thus is also quasi embedded in the insert and thus is not uncovered towards the front and thus towards the niche opening. Thus, due to this receiving portion in the insert a certain front side shock protection for the cover is also developed. Moreover, due to this construction it is also achieved that the cover cannot fall out in an undesired way from the niche towards the front.

Preferably it is envisaged that the engagement area extends both into the receiving portion as well as into the wall strips. Thereby, the very section of the engagement portion, which is uncovered and is positioned closer to the niche opening than the cover is more easily accessible with a tool and the cover is then also easy to be engaged from behind.

In particular, an improved lever effect when positioning the tool and bearing against the wall strip is thereby also achieved, in order to be able to lift the cover from the receiving portion.

Preferably, it is envisaged that the cover is formed integrally or in one piece, in particular from metal. Thereby it is constructed with a minimum number of components and the assembly effort for attaching the cover to the side walls of the insert as well as the removal is thereby facilitated in a particularly fast and simple way. Precisely due to this construction undesired interfaces are also not created and thus also no gap is created, through which liquid could possibly seep through the cover towards the back to the insert.

Preferably it is envisaged that the cover is configured to be trapezoidal. Thereby it is preferably adjusted to the walls of the insert forming the niche. Due to the trapezium shape a certain pre-tensioning is also facilitated so that the cover upon insertion into the niche and thus upon resting against the side walls of the insert viewed in the width direction is also pressed together to some extent, whereby the precise fitting and due to the then acting pre-tension on the insert can achieve an improved holding.

In a particularly advantageous way it is envisaged that the cover is held to the insert by magnetic holding forces. In particular, for this purpose it is envisaged that at least one magnet is disposed on the insert, and the cover at least partly is configured from a magnetically interacting material. Through the use of such a construction on one hand a very securely positioned holding of the cover on the insert is achieved, and on the other hand a very simple and fast possibility of a non-destructively releasable attachment and removal of the cover from the insert is facilitated. Moreover, the magnetic holding devices are resistant against environmental influences, in particular also liquids possibly reaching the magnets in an undesired way. Thus, it is precisely due to the holding with the magnets that a very robust and low-wear holding also is facilitated.

With the objects of the invention in view, there is also provided a household cooling appliance including a dispenser unit for dispensing a liquid and/or free flow refrigerated goods. The dispenser unit includes an insert having vertical side walls bounding a niche into which a receiving vessel can be inserted for receiving the liquid and/or free flow refrigerated goods to be dispensed. The dispenser unit, which can also be referred to as an output unit, thus includes a niche open and accessible at the front side.

An important concept of the further independent aspect of the invention is to be seen in that at least one vertical side wall of the insert is partly covered on the front side with a plate-shaped cover that is separate from the insert and this cover is held at least with one magnet on the wall. Through the use of such a construction, a securely positioned attachment of the cover can be facilitated. Moreover, a robust and low-wear holding of the cover on the insert is achieved.

In an advantageous way, it is envisaged that the side wall of the insert includes a receiving bag, in which a magnet is disposed. Due to such an immersed positioning of the magnet it is also disposed so as to be securely positioned. In this connection then, an improved holding of the cover can also be provided, since it cannot only be in direct contact with the magnet, but additionally also can contact the surface of the side wall of the insert circumferentially.

Preferably it is envisaged that the magnet in the state, in which it is disposed in the receiving bag, is disposed flush with wall areas of the side wall of the insert, which are adjacent the receiving bag, or offset towards the back relative to these wall areas. The above-mentioned advantages thereby are once again improved, since a contacting of the cover on a larger surface on these wall areas of the side wall is facilitated. Moreover, due to such a flush attachment of the magnet on the side wall it is positioned once again so as to be better protected so that an undesired dropping out or damage when inserting the cover is avoided.

Preferably it is envisaged that the receiving bag includes an insertion slot, into which the magnet can be inserted. Thereby it is also very easy to assemble and also to disassemble so that it can also be exchanged in this connection. Nevertheless, due to the construction with an insertion slot a securely positioned holding of the magnet is also achieved. Additionally, fastening elements for fastening the magnet in such a construction are no longer required.

Preferably, it is envisaged that the insertion slot includes a rear wall and on opposite sides stops limiting the insertion slot towards the front, which are disposed so as to be spaced apart from the rear wall offset towards the front so that the magnet is insertable between the rear wall and the stops. Thereby the mounting as well as the holding is rendered easier or improved.

Preferably it is envisaged that the magnet on its front side facing the cover includes depressions on opposite sides, wherein in the mounted state of the magnet in the insertion slot the depressions contact the stops on the rear side and a portion of the magnet protruding between the depressions extends between the stops towards the front. Such a concept is very convenient to mount and a holding of the cover, which requires reduced construction space, is achieved.

Preferably it is envisaged that the magnet is non-destructively releasably disposed on the side wall.

In particular, it is also envisaged that the niche is bounded by sidewalls of the insert and at least the side walls are partly covered on the front side and thus towards the niche by a cover that is separate from the insert and at least one side wall includes an engagement recess for an engagement with a tool and for lifting the cover with the tool from the side wall.

In particular, the household cooling appliance is a rack-mounted model. It can in particular be disposed in a furniture niche of a furniture wall.

Advantageous embodiments of the respective independent aspects of the invention are each to be regarded as advantageous embodiments of the respective other independent aspect of the invention.

The positions and orientations given for an intended use and an intended configuration of the appliance and for a user then standing in front of the appliance and viewing in the direction of the device are indicated with the indications "top," "bottom," "front," "rear," "horizontal," "vertical," "depth direction," "width direction," "height direction," etc.

Further features of the invention are derived from the claims, the figures, and the description of the figures. The aforementioned features and feature combinations mentioned in the description, as well as the features and feature combinations mentioned in the following description of the figures and/or shown in the figures alone can be used not only in the respective indicated combination, but also in other combinations, without departing from the scope of the invention. Thus, embodiments of the invention are also to be considered as included and disclosed, which are not explicitly shown and explained in the figures, but by separated feature combinations derived from the explained embodiments and can be generated therefrom. Thus, explanations and feature combinations are also to be regarded as disclosed, which thus do not include all features of an originally formulated independent claim. Moreover, embodiments and feature combinations, in particular due to the embodiments set out above, are to be considered as disclosed, which go beyond the feature combinations set out in the references to the claims or deviate therefrom.

Other features which are considered as characteristic for the invention are set forth in the appended claims.

Although the invention is illustrated and described herein as embodied in a household cooling appliance including a dispenser unit for liquid and/or free flow refrigerated goods, having an insert with a niche and a separate cover for insertion walls, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 7 is a vertical sectional view taken along a line VII-VII of the embodiment according to FIG. 5 with already inserted magnets; and FIG. 8 is an enlarged view of a partial portion VIII of the view shown in FIG. 7.

DETAILED DESCRIPTION OF THE INVENTION

Figure 1:
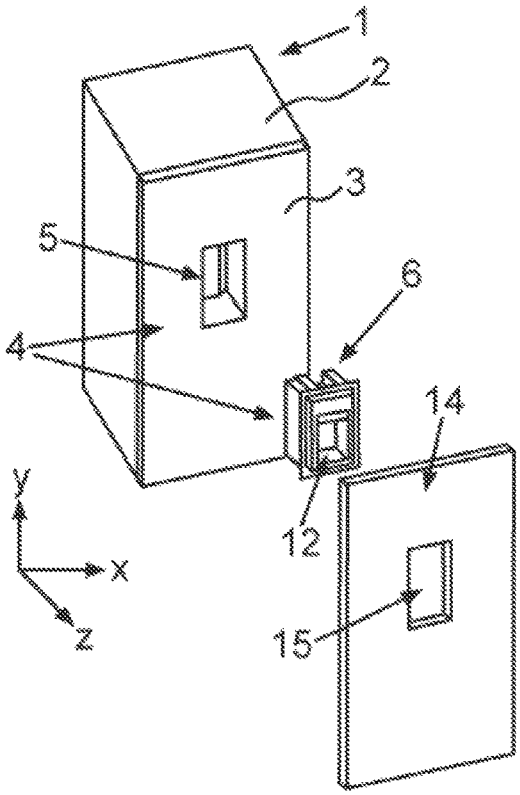
FIG. 1 is a diagrammatic, exploded, perspective view of an embodiment of a household cooling appliance according to the invention.

Referring now in detail to the figures of the drawings, in which the same elements and elements having the same function are provided with the same reference signs, and first, particularly, to FIG. 1 thereof, there is seen a diagrammatic view of a household cooling appliance 1, which is configured for storing and preserving food items and which, for instance, can be a refrigerator appliance, a freezer, or a refrigerator/freezer combination device. The household cooling appliance 1 includes a housing 2, in which at least one receiving space for food items is provided. This receiving space is capable of being closed on the front side by a door 3, which in FIG. 1 is shown in the closed state and which is disposed pivotably on the housing 2. The household cooling appliance 1 includes an output unit or a dispenser unit which is merely indicated in an exemplary way by reference sign 4 in FIG. 1 and in which individual components are only partly shown. The dispenser unit 4 is configured for dispensing liquid and/or free flow refrigerated goods. Thus, a drink and/or an ice cube form element, for instance ice cubes or crushed ice can be dispensed.

For this purpose, in the illustrated embodiment, for instance, the door 3 includes a recess 5, into which the dispenser unit 4 is inserted, so that in the closed state of the door 3 the dispenser unit 4 is accessible from the front in order to be able to dispense the liquid and/or the free flow refrigerated goods.

Figure 2:
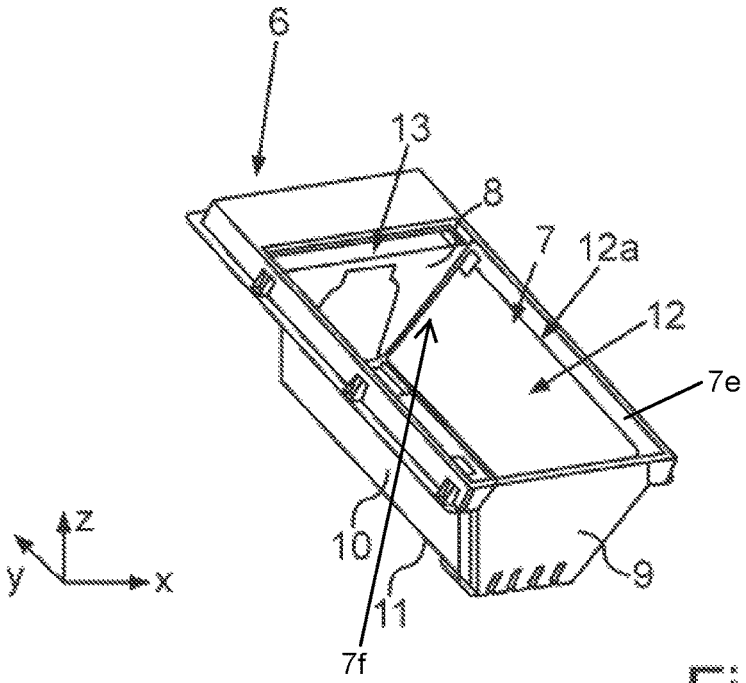
FIG. 2 is a perspective view of an insert of a dispenser unit, which is configured for dispensing a liquid and/or free flow refrigerated goods and is a component of the household cooling appliance according to FIG. 1.

The dispenser unit 4 includes an insert 6, which is in particular formed of plastic in an integral or one-piece manner. The insert 6 includes several walls 7, 8, 9, 10 and 11 (FIG. 2), which bound a niche 12. The recess or the niche 12 is configured for housing or insertion of a receiving vessel so that then liquid and/or free flow refrigerated goods to be dispensed can be brought in from the above. The niche 12 is accessible from the front. The dispenser unit 4 includes a dispenser opening, which in particular ends in a niche ceiling wall 8 and through which the liquid and/or the free flow refrigerated goods can be brought into the niche 12 and from there can be brought into the inserted receiving vessel. In FIG. 2 the insert 6 is shown in a perspective view.

This insert 6 moreover includes in an exemplary way a receptacle 13, which is configured as a slot. An electronics module is insertable into the receptacle 13.

FIG. 1 moreover also shows a decorative plate 14, which is separate from the door 3, is preferably present and can be a furniture front plate. This decorative plate 14 is preferably attachable to the door 3 and covers the same at the front side. This decorative plate 14 also includes a recess 15, through which the dispenser unit 6 is accessible from the front side. In particular, the dispenser unit 4, particularly the insert 6, is disposed on the decorative plate 14, in particular fastened thereto.

Figure 3:
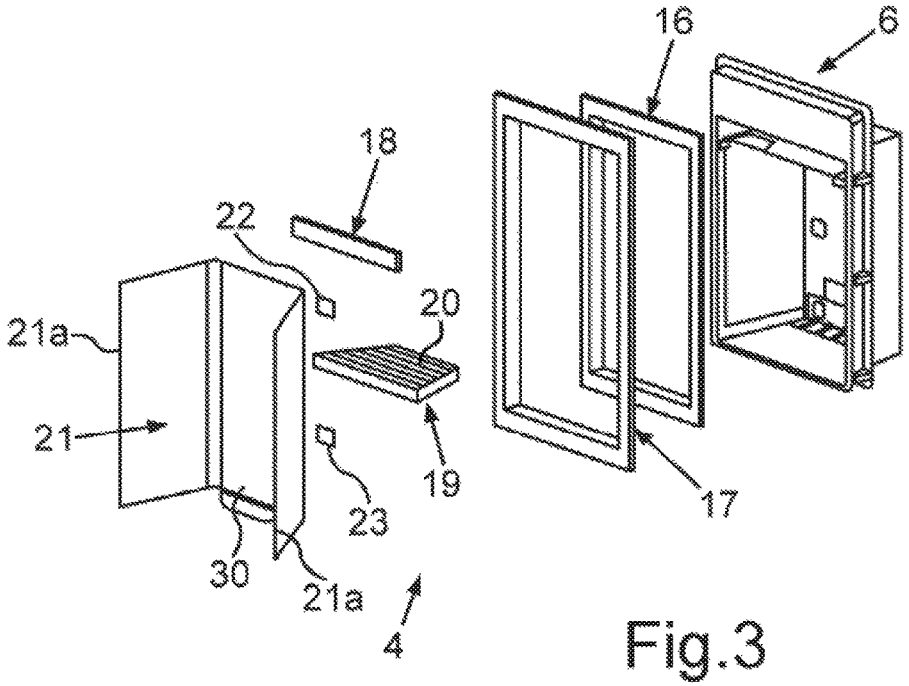
FIG. 3 is an exploded, perspective view of components of a dispenser unit of the household cooling appliance.

FIG. 3 shows an exploded view of the components of the dispenser unit 4. The insert 6, which was explained with reference to FIG. 2, can be recognized in FIG. 3. Moreover, a frame part 16 is shown, which can be placed upon the front side of the insert 6. In the illustrated embodiment, moreover an additional front frame 17 is present, which then again is slid upon the frame 16 and grasps around the front portion of the insert 6.

Moreover, an electronics module 18 is shown, which is insertable in the receptacle 13. Furthermore, FIG. 3 shows a drip tray 19, which is inserted into the niche 12 and rests on a bottom 9 of the insert 6. Additionally, a cover grid 20 is provided, which is non-destructively releasably attached on the drip tray 19 and on which a receiving vessel can be placed. Liquid that occurs in the niche 12 in an undesired way is then collected in the drip tray 19. This liquid can drip or seep through the cover grid 20 into the drip tray 9.

Moreover, FIG. 3 also shows an embodiment of a cover 21 which is separate from the insert 6 and is integrally formed, in particular from metal. The cover 21 can be inserted into the niche 12 and then is present as component on the viewing side. This means that the cover 21 bounds the niche 12 directly on the side walls. As can be seen, the cover 21 is configured to be uneven, in particular trapezoidal. The cover is thereby adjusted to the geometry of the side walls 7, 10 and 11 of the insert 6 and in the mounted state is located there in contact extensively with a large surface. The cover 21, which is separate from the insert 6, is held by magnetic holding forces. Connection magnets 22 and 23 are shown in FIG. 3 as examples thereof.

Figure 4:
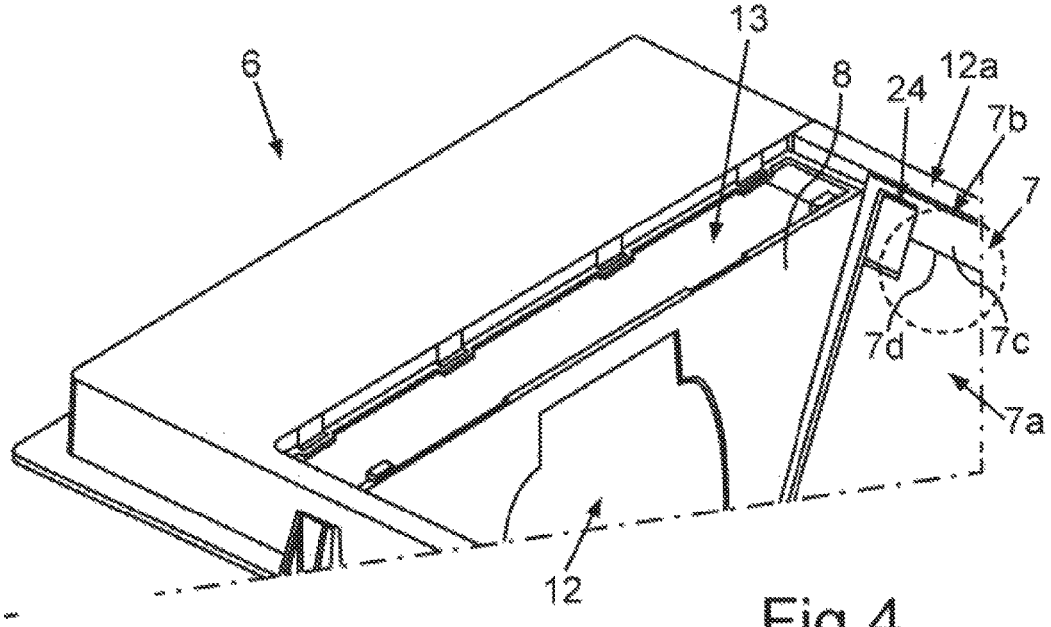
FIG. 4 is an enlarged, fragmentary, perspective view of a portion of the insert according to FIG. 2.

As can also already be seen from FIG. 2, and as is shown in FIG. 4 in an enlarged view of the insert 6, an engagement recess 24 is formed in a top portion in the height direction (y direction) of the niche 12. A tool 50, for instance a screw driver, can be engaged into the engagement recess 24. The engagement recess 24 is formed in the side wall 7 at a top end 7*f* of a front surface area 7*e* of the side wall 7 and adjacent a niche opening 12*a* of the niche 12 and thus at the front side of the niche 12. It is also configured immediately adjacent the ceiling wall 8 in the side wall 7.

Moreover, a lowered receiving area 7*a* is configured in the side wall 7. The cover 21 is disposed and at least partly immersed in the receiving area 7*a* in the mounted state of the cover 21. This receiving area 7*a* is configured to be offset towards the back relative to a front edge 7*b* of the side wall 7 in the depth direction (z direction). A wall strip 7*c* is thereby formed between the receiving area 7*a* and the front edge 7*b*. The wall strip 7*c* is elevated in comparison with the receiving area 7*a* towards the niche 12. Thus, at the transition 7*d* between the receiving area 7*a* and the wall strip 7*c* a step is formed, which also serves as a stop for a front edge 21*a* of the cover 21.

As can be recognized in FIG. 4, the engagement recess 24 extends both in the receiving area 7*a* as well as in the wall strip 7*c*. In the mounted state of the cover 21, the engagement recess 24 is only partly covered by the cover 21 and in that section in which the receiving area 7*a* extends. That section of the engagement recess 24, which extends in the wall strip 7*c*, then is not covered by the cover 21.

Figure 5:
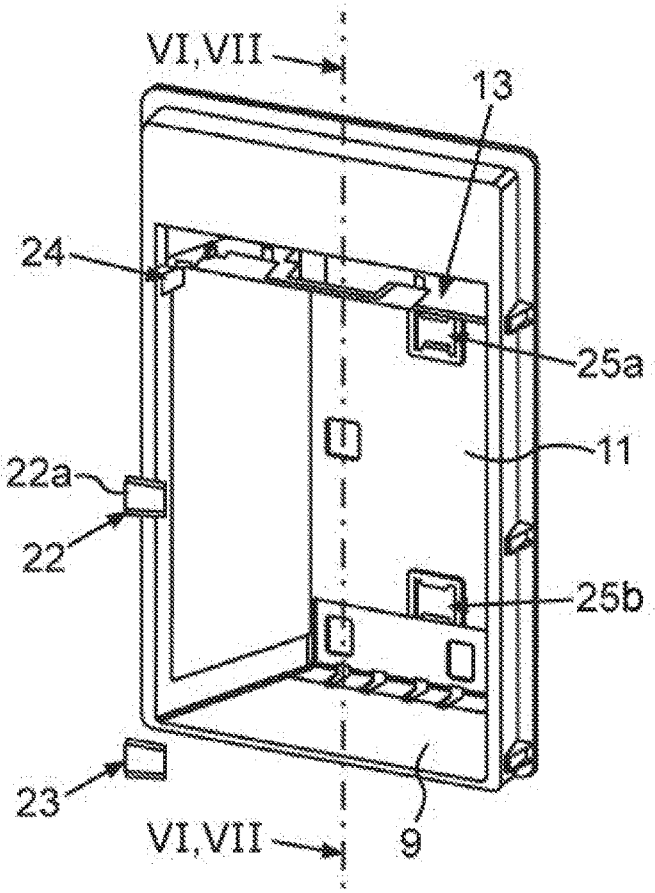
FIG. 5 is a perspective view of the insert according to FIG. 2 with a separately shown magnet for holding a separate cover.

Accordingly, a correspondingly constructed engagement recess 24 is also formed on the opposite side wall 10, as it is shown in FIG. 5. It can be envisaged that a corresponding engagement recess 24 is formed only in the sidewall 7 or only in the side wall 10 or, as it is advantageously envisaged, an engagement recess 24 is configured in each sidewalls 7, 10.

In comparison with the preferred position of the engagement recess 24 it can also be envisaged that the same is offset further down and thus for instance also is disposed centrally with regard to the height of a side wall 7, 10 and/or in a bottom area and thus is provided adjacent the bottom wall 9 in a side wall 7, 10.

Preferably, the cover 21 upon insertion in the niche 12 is to be slightly pressed together and thus then quasi prestressed towards the outside. Thereby, the positioning in the receiving area 7*a* is then improved and a certain self-holding is then already achieved.

The holding of the cover 21 is preferably supported by preferably several magnets, in particular two magnets 22 and 23. The magnets 22 and 23 each are disposed in a receiving bag or receptacle 25*a* or 25*b* in a preferably non-destructively releasable way, as is shown in FIG. 5. The magnets 22 and 23 thus are disposed on the side wall 11, which represents a rear wall in this embodiment.

Figure 6:
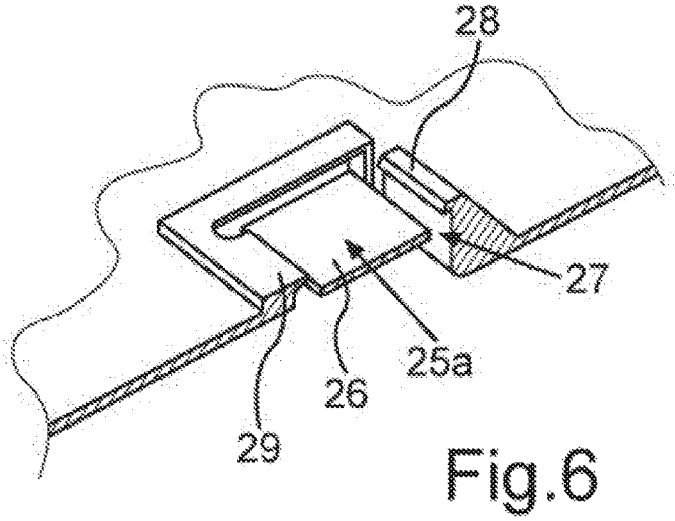
FIG. 6 is a fragmentary, perspective view of an interface for a side wall of the insert taken along a line VI-VI of FIG. 5 in a portion of a receiving bag for receiving a magnet.

In this connection, a perspective sectional view taken along the section line VI-VI in FIG. 5 is shown in FIG. 6. The receiving bag 25*a* includes a rear wall 26, which the magnet 22 contacts in the inserted state.

The receiving bag 25*a* is in particular formed with an insertion slot 27, into which the magnet 22 is insertable. The insertion slot 27 includes this already-mentioned rear wall 26 and the insertion slot 27 on opposite sides and thus also stops 28 and 29 delimiting the receiving bag 25*a*. These stops 28 and 29, as viewed in the depth direction and thus in the z direction, are disposed so as to be spaced apart from the rear wall 26 offset towards the front so that the magnet 22 is disposed and inserted between the rear wall 26 and the stops 28 and 29 and thereby also correspondingly held.

As can be seen in FIG. 7 and in the enlarged view of the partial section VIII in FIG. 8, in this vertical sectional view taken along the section line VII-VII in FIG. 5, the installed position of the magnets 22 and 23 is shown. As can be seen, the magnet 22 in its front side 22*a* (FIG. 5) facing the cover (21) includes bar-like depressions 22*b* and 22*c*. These depressions 22*b* and 22*c* engage behind the stops 28 and 29 in the mounted state. A protruding portion 22*d* of the magnet 22, which is formed between the depressions 22*b* and 22*c*, protrudes in the depth direction relative to these depressions 22*b* and 22*c* towards the front. It is in particular configured such that in the mounted state of the magnet 22 the front side 22*a* in the area of this protruding portion 22*d* is in particular flush with the front sides of the stops 28 and 29 so that, as is shown in FIG. 7 and FIG. 8, a rear wall 30 of the cover 21 contacts the protruding portion 22*d* and also the stops 28 and 29.

A corresponding construction of the receiving bag 25*b* and the magnet 23 is envisaged. This, too, can be seen in FIG. 7.

The invention claimed is:

1. A household cooling appliance, comprising:

a dispenser unit for dispensing at least one of a liquid or free flow refrigerated goods, said dispenser unit including an insert;

said insert having a front and said insert having side walls bounding a niche into which a receptacle can be inserted for receiving the at least one of liquid or free flow refrigerated goods to be dispensed;

a cover being separate from said insert, said cover partly covering at least said side walls at said front; and at least one of said side walls having an engagement recess for engagement with a tool and for lifting said cover from said insert with the tool.

2. The household cooling appliance according to claim 1, wherein said engagement recess is partly formed in a front surface area of said at least one side wall that is not covered by said cover.

3. The household cooling appliance according to claim 1, wherein said engagement recess is partly formed in a surface area that is covered by said cover permitting said cover to be engaged from behind by the engagement of the tool in said engagement recess.

4. The household cooling appliance according to claim 1, wherein said engagement recess is formed on a top end of said at least one side wall.

5. The household cooling appliance according to claim 1, wherein said cover has a front edge, and said engagement recess is formed in said at least one side wall protruding beyond said front edge of said cover towards said front in a mounted state of said cover.

6. The household cooling appliance according to claim 1, wherein:

said at least one side wall includes recessed receiving area for said cover;

said cover is at least partly recessed in said receiving area in a mounted state; and said receiving area is offset backwards in comparison with a front edge of said at least one side wall forming an elevated wall strip between said front edge and said receiving area.

7. The household cooling appliance according to claim 6, wherein said engagement recess extends both into said receiving area as well as into said wall strip.

8. The household cooling appliance according to claim 1, wherein said cover is formed in one piece.

9. The household cooling appliance according to claim 1, wherein said cover is formed of metal.

10. The household cooling appliance according to claim 1, wherein said cover has a trapezoidal shape.

11. The household cooling appliance according to claim 1, which further comprises at least one magnet holding said cover on said insert.

12. A household cooling appliance, comprising:

a dispenser unit for dispensing at least one of a liquid or free flow refrigerated goods, said dispenser unit including an insert;

said insert having a front and said insert having side walls bounding a niche into which a receptacle can be inserted for receiving the at least one of liquid or free flow refrigerated goods to be dispensed;

a plate-shaped cover being separate from said insert, said cover partly covering at least one of said side walls at said front; and at least one magnet holding said cover on said at least one side wall;

said at least one side wall including a receiving recess in which said at least one magnet is disposed, said receiving recess having an insertion slot said at least one magnet being insertable into said insertion slot, said insertion slot including a rear wall and stops bounding said insertion slot on opposite sides thereof and said stops being spaced apart from said rear wall offset towards said front for insertion of said at least one magnet between said rear wall and said stops.

13. The household cooling appliance according to claim 12, wherein said at least one magnet disposed in said receiving recess has a front side facing said cover, said front side is flush with wall portions of said at least one side wall adjacent said receiving recess or offset backwards from said wall portions.

14. The household cooling appliance according to claim 12, wherein:

said at least one magnet has a front side that faces said cover and depressions on opposite sides;

said depressions contact said stops on a rear side of said stops with said at least one magnet disposed in said insertion slot; and said at least one magnet has an area that protrudes between said depressions and protrudes between said stops towards said front.

15. The household cooling appliance according to claim 12, wherein said at least one magnet is non-destructively releasably disposed on one of said side walls.

16. The household cooling appliance according to claim 12, wherein said at least one side wall has an engagement recess for engagement with a tool permitting said cover to be lifted from said insert with the tool.

* * * * *